US010184241B2

(12) United States Patent
Johnson

(10) Patent No.: US 10,184,241 B2
(45) Date of Patent: Jan. 22, 2019

(54) CONSTRUCTION PANEL AND RELATED METHODS

(75) Inventor: Brian Wade Johnson, Delta, CO (US)

(73) Assignee: Brian W. Johnson, Delta, CO (US)

( * ) Notice: Subject to any disclaimer, the term of this patent is extended or adjusted under 35 U.S.C. 154(b) by 0 days.

(21) Appl. No.: 13/491,115

(22) Filed: Jun. 7, 2012

(65) Prior Publication Data

US 2012/0311955 A1 Dec. 13, 2012

Related U.S. Application Data

(60) Provisional application No. 61/520,232, filed on Jun. 8, 2011.

(51) Int. Cl.
*E04B 1/10* (2006.01)
*E04B 1/24* (2006.01)

(52) U.S. Cl.
CPC ..... *E04B 1/10* (2013.01); *E04B 2001/2496* (2013.01); *Y10T 29/49826* (2015.01)

(58) Field of Classification Search
CPC ..... E04B 2001/2496; E04B 2001/2415; E04B 1/24; E04B 1/26; E04B 1/08; E04C 2003/0491; E04C 2/384
USPC ..... 52/656.9, 656.7, 638, 167.1, 167.3, 695
See application file for complete search history.

(56) References Cited

U.S. PATENT DOCUMENTS 1,994 A * 2/1841 Price et al. ..... 52/695
2,126,511 A * 8/1938 Soule ..... 52/223.6
3,608,259 A * 9/1971 Iwens ..... 52/263
4,890,437 A * 1/1990 Quaile ..... 52/690
5,271,197 A * 12/1993 Uno et al. ..... 52/167.1
5,657,606 A * 8/1997 Ressel et al. ..... 52/690
5,664,388 A * 9/1997 Chapman et al. ..... 52/653.1
6,073,413 A * 6/2000 Tongiatama ..... 52/693
6,185,898 B1 * 2/2001 Pratt ..... 52/657
6,308,469 B1 * 10/2001 Leung ..... 52/167.3
6,460,297 B1 * 10/2002 Bonds et al. ..... 52/79.1
6,941,718 B1 * 9/2005 diGirolamo et al. ..... 52/695
7,231,742 B2 * 6/2007 Majlessi ..... 52/167.3
7,299,596 B2 * 11/2007 Hildreth ..... 52/695
8,276,328 B2 * 10/2012 Pepin ..... 52/167.3
(Continued)

FOREIGN PATENT DOCUMENTS

JP 2004-027531 1/2004
JP 2009-293214 12/2009

OTHER PUBLICATIONS

PCT/US2012/041321; filed Jun. 7, 2012; Brian W. Johnson; International Search Report dated Jan. 21, 2013.

*Primary Examiner* — Kyle J. Walraed-Sullivan
(74) *Attorney, Agent, or Firm* — Thorpe North & Western, LLP

(57) ABSTRACT

A construction panel for use in erecting structures comprises a pair of vertical support members and at least one lower horizontal member, extending between lower ends of the vertical support members. At least one header member extends between upper ends of the pair of vertical support members. At least one horizontal purlin member braces the vertical supports intermediate the lower horizontal member and the header member. At least one intermediate vertical member extends between the at least one horizontal purlin member and one of: another horizontal purlin member; the header member; and the at least one lower horizontal member.

17 Claims, 2 Drawing Sheets

(56) References Cited

U.S. PATENT DOCUMENTS

| | | | |
|---|---|---|---|
| 2002/0108332 | A1 | 8/2002 | Timmerman, Sr. et al. |
| 2003/0009964 | A1 | 1/2003 | Trarup et al. |

* cited by examiner

CONSTRUCTION PANEL AND RELATED METHODS

PRIORITY CLAIM

Priority and benefit is claimed of U.S. Provisional Patent Application Ser. No. 61/520,232, filed Jun. 8, 2011, which is hereby incorporated herein by reference in its entirety.

BACKGROUND OF THE INVENTION

Field of the Invention

The present invention relates generally to the field of construction of buildings and structures. More particularly, the present invention relates to a construction panel and system that can be used to provide structures with superior shear load carrying capability.

Related Art

The vast majority of structures constructed today are subject to loading conditions that require walls of the structure to adequately carry lateral loads from such forces as wind, seismic activity, and some gravitational loads. As a result, many wood frame buildings use "shear walls" to resist lateral loads. A shear wall is typically formed by the application of one or more types of sheeting, such as plywood, fiberboard, particleboard, and/or drywall (gypsum board), to the inside or outside (or both) sides of a dimensional lumber (or other framing material) wall frame. The sheeting is fastened to the wall frame at many points to create a shear wall. The sheeted shear wall is beneficial, and in some applications even necessary, to transmit lateral forces acting upon the frame of the structure to the foundation of the structure.

In a typical application, a shear wall is formed while a building or structure is erected. In applications where wooden framing is utilized, dimensional lumber such as "2×4s," "2×6s," 2×8s," etc., are first used to create a framework of mostly vertical components that serve to carry loads vertically to the foundation of the structure. Typically, nails are used to secure the components to one another while the wall is erected. While such a system has proven, over many years, to effectively provide the load-carrying capability necessary to withstand vertical loading experienced during normal use, such systems are not well suited to carry lateral loads applied by wind, seismic activity and the like.

As such, most building codes require the addition of sheeting to the outer (or inner) face of the frame components. The shear panels, which can be as simple as plywood sheets, must be nailed or screwed in specified patterns to meet code. It has been found, however, that when walls constructed in such a manner fail under wind or seismic loading conditions, failure is often initiated at the locations where the shear panels were nailed or screwed to the underlying framework. Thus, while this conventional manner of providing shear strength to walls is effective in some cases, failure of the system has been experienced in others. Also, the fact that such sheeting is required often considerably increases the cost of the walls of the structure, as well as the time required to erect the walls.

SUMMARY OF THE INVENTION

In accordance with one aspect of the invention, a construction panel for use in erecting structures is provided, including a pair of vertical support members and at least one lower horizontal member, extending between lower ends of the vertical support members. At least one header member can extend between upper ends of the pair of vertical support members. At least one horizontal purlin member can brace the vertical supports intermediate the lower horizontal member and the header member. At least one intermediate vertical member can extend between the at least one horizontal purlin member and one of: another horizontal purlin member; the header member; and the at least one lower horizontal member. At least two diagonal support members can brace the vertical support members, each of the at least two diagonal support members extending from one of the vertical support members to a horizontal member. A plurality of fastening plates can be arranged about the construction panel to couple members one to another at each of a plurality of connection joints created between adjoining members.

In accordance with another aspect of the invention, a method of forming a wall of a building is provided, including obtaining a plurality of panels as described herein; arranging the panels such that each abuts a side of another; and fastening the panels one to another.

In accordance with another aspect of the invention, a method of forming a construction panel is provided, including: arranging a pair of vertical support members substantially parallel to one another; coupling at least one lower horizontal member to the vertical support members; coupling at least one header member between upper ends of the pair of vertical support members; bracing the vertical support members with at least one horizontal purlin member positioned intermediate the lower horizontal member and the header member; coupling at least one intermediate vertical member between the at least one horizontal purlin member and one of: another horizontal purlin member; the header member; and the at least one lower horizontal member; coupling at least two diagonal support members between a horizontal member and one of the vertical support members; wherein each of a plurality of connection joints created between abutting members are fastened by a fastening plate at each connection joint.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
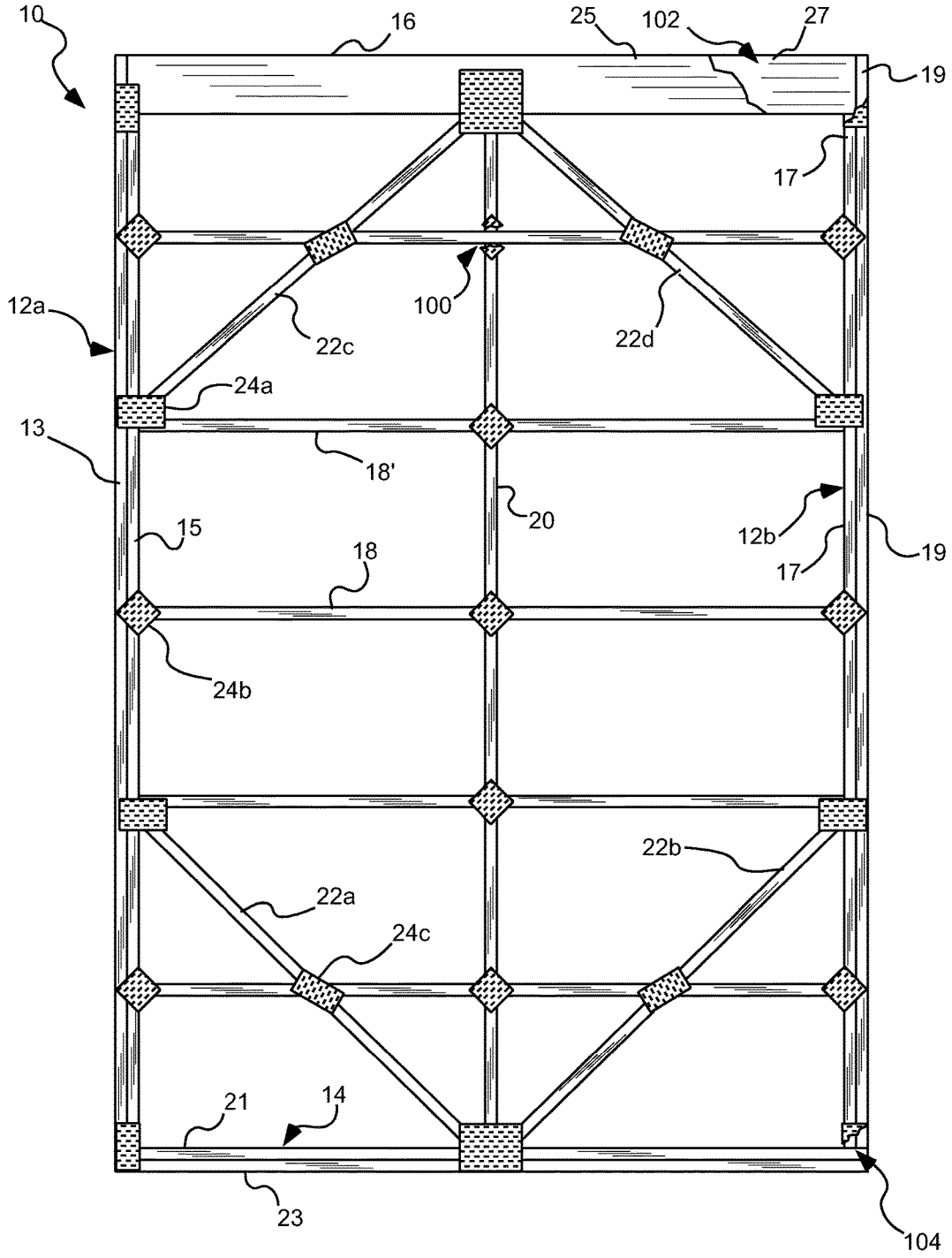
FIG. 1 is a plan view of a construction panel in accordance with an embodiment of the invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "a construction panel" can include one or more of such panels.

The term "panel" or "construction panel," as used herein, is intended to refer to an individual, discrete construction unit that can be readily manipulated on its own and placed adjacent to, atop, or beneath other construction units. Generally, construction panels are coupleable one to another, and in some embodiments can be removably coupleable one to another while remaining intact. Construction panels can be formed of various sub-components (oftentimes dimensional lumber and connecting plates), in which case each of the various sub components will be coupled to one another such that the individual construction panels are sufficiently strong and rigid to be handled without the sub components becoming uncoupled. Construction panels will typically be sufficiently strong and rigid to be handled, raised erect, lifted, slid along the ground, moved into position, etc., while remaining intact (e.g., while retaining their structural integrity).

As used herein, the terms "attached," "coupled," fixed," etc., can be used to describe a condition in which two or more components are coupled to one another in such a manner that they function as intended: that is, the force required to uncouple the components is sufficiently large such that the components will remain attached to one another during the service for which they were designed. In some embodiments of the invention, various components can be "permanently" coupled to one another: in such a case, the components are coupled to one another such that some deformation of one or both of the components, or the fasteners used to couple the components, will occur if the components are uncoupled from one another. One example of such a coupling can occur when two or more panels are nailed to one another.

In other aspects, various components can be removably coupled to one another such that they can be separated without causing permanent deformation of the components, or the fasteners used to couple the components. One example of such a coupling can occur when two or more panels are bolted to one another (in which case, removal of nuts coupled to bolts can result in uncoupling of the components without damaging the nuts or the bolts).

Directional terms, such as "vertical," "horizontal," "upper," "lower," etc., are used herein to describe relative positions of various components. It is to be understood that such usage is an effort to most clearly describe, and, where applicable, claim, the features of the invention and is not be to limiting unless the context clearly indicates otherwise. Such directional terms are used in a manner that will be readily understood by one of ordinary skill in the art having possession of this disclosure.

As used herein, the term "substantially" refers to the complete or nearly complete extent or degree of an action, characteristic, property, state, structure, item, or result. As an arbitrary example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

The present invention relates generally to wall panels that can be installed individually or collectively when erecting a building or structure to provide superior shear loading capabilities to walls of the building without necessarily requiring that sheathing materials be attached to the framework of the building. The panels also provide the structural equivalent of a vertical post where two panels are joined side-by-side. While attaching sheathing materials (such as plywood, fiberboard, particleboard, gypsum, etc.) can increase the shear load capacity of the walls, it has been found that the present panels provide sufficient shear load capacity to the walls without requiring the additional support of the sheathing materials.

The present panels not only advantageously provide such shear loading capacity, they also do so with wall panels that are modular in nature, and very easy to handle, transport, install, etc. Such wall panels can be individually constructed and shipped to job sites ready to be installed as part of a wall of a building or structure. As the panels comprise individual units, they can each be easily manipulated, stacked, shipped, moved, etc., while remaining intact and structurally sound. Once delivered to a job site, they can be very quickly moved into position and installed as a portion of a wall.

Due to the simplicity of design of the present wall panels, they can either be pre-assembled and delivered to a job site for installation, or can be relatively easily assembled or created at the job site, and then installed. In some embodiments, the panels are assembled in a controlled manufacturing facility and monitored by a third party inspection service using approved guidelines to ensure quality compliance. Also, the wall panels can be tailored to fit within virtually any design constraints. For example, one exemplary wall panel is formed from "2×4" dimensional lumber and includes a width of about eight feet and a height from about eight feet up to about sixteen feet. Another exemplary wall panel can be formed from "2×6" dimensional lumber and can have a similar width with a height of up to about twenty feet. However, the design of the present invention readily allows panels to be modified for a variety of applications. For example, the wall panels can be formed from "2×8" lumber, "2×10" lumber, LVL or other engineered wood products, etc., where a thicker, stronger or taller wall is required. The width of the wall panels can also be tailored to fit a particular need, anywhere from two feet in width up to sixteen feet (and more) in width. Similarly, the height of the wall panels can easily be adjusted to achieve a desired wall height.

The buildings or structures that can be formed from the present invention can include agricultural buildings, commercial buildings, residential buildings, and the like. When the term "structure" or "building" is used herein, it is to be understood that the application being discussed can include a variety of building types known to those of ordinary skill in the art.

Turning now to the figures, as shown most clearly in FIG. 1, one embodiment of the invention provides a construction or wall panel 10 for use in erecting structures. The panel can include a pair of vertical support members 12*a*, 12*b* that are typically positioned at extreme lateral edges of the panel (although in some embodiments, some portions of the wall panel may extend laterally beyond the vertical support members). At least one lower horizontal member 14 can extend between lower ends of the vertical support members. At least one header member 16 can extend between upper ends of the pair of vertical support members. At least one horizontal purlin/stud member 18 can brace the vertical support members intermediate the lower horizontal member and the header member. The horizontal purlin member extending from an inside portion of one vertical support member to an inside portion of the other vertical support member can provide extremely high shear strength to the wall panel.

While not so required, in one aspect of the invention, at least one intermediate vertical member 20 can extend between the at least one horizontal purlin member 18 and one of: another horizontal purlin member (18', for example); the header member 16; and the at least one lower horizontal member 14. At least two diagonal support members 22*a*, 22*b*, 22*c*, 22*d*, etc., can brace the vertical support members. Each of the at least two diagonal support members can extend from one of the vertical support members to a horizontal member, such as the lower horizontal member 14, the header member 16, the horizontal purlin members 18, 18', etc.

A plurality of fastening plates 24*a*, 24*b*, 24*c*, etc., can be arranged about the construction panel to couple the various members one to another at each of a plurality of connection joints created between adjoining members. While not so required, in one aspect of the invention, a fastening plate is utilized at every joint where one or more members are coupled to one another. Also, while not required in every embodiment, typically the fastening plates will be attached in pairs: with one plate attached to the "front" or "outside" of the wall panel, and one plate attached to the "rear" or "inside" of the wall panel. In this manner, the various components are attached to one another in a very secure manner at each connection point. The resulting wall panel is very rigid and capable of withstanding considerable shear loads without any sheathing applied thereto.

As discussed above, the various horizontal support members, vertical support members, diagonal support members, etc., can be formed from readily obtainable dimensional lumber such as common "2×4s," "2×6s," etc. The fastening plates 24*a*, 24*b*, etc., can also be formed from readily obtainable materials or devices including, without limitation, nail plates, gang nail plates, truss plates, and the like, as would be appreciated by one of ordinary skill in the art having possession of this disclosure. Such fasteners can be nailed into position into the various vertical, horizontal, and/or diagonal support members, or can be screwed into position, pressed or rolled into position, etc.

In some embodiments of the invention, the horizontal purlin members 18, 18', etc., abut inside surfaces of each of the vertical support members 12*a*, 12*b* to thereby span the vertical support members. Typically, the intermediate vertical support members 20 span from one horizontal member to another (as shown, for example, at breakaway view 100) to transfer load vertically from one horizontal member to another. This same configuration typically applies to the diagonal support members 22*a*, 22*b*, etc., as well.

While the diagonal support members 22*a*, 22*b*, etc., can brace the panel 10 in a variety of locations, in one aspect of the invention (as shown in FIG. 1) they extend from a horizontal center of the lower horizontal support member 14 to each of the vertical support members 12*a*, 12*b*. Diagonal support members 22*c*, 22*d* extend from a horizontal center of the header member 16 to each of the vertical support members 12*a*, 12*b*. The diagonal support members shown in the figures are generally formed of two pieces: one that extends below the horizontal purlin/stud, and one that extends above the horizontal member (the two diagonal pieces and the horizontal piece can be joined where they would otherwise intersect). In other embodiments, however, the diagonal member can extend as a full piece, with the horizontal member intersecting the diagonal member and being formed of two (or more) pieces.

While the lower horizontal support member 14 and the header member 16 can be associated with the vertical support members 12*a*, 12*b* in a number of various configurations, in one aspect of the invention, the lower horizontal support member 14 is formed of two horizontal components 21, 23. One or both of these components can be formed of treated (or "green") lumber as they might be positioned near a ground surface. In the embodiment shown (in breakaway view 104), the horizontal components 21, 23 extend beneath each of two vertical components 13, 15 and 17, 19 that comprise the vertical support members 12*a*, 12*b*, respectively. In other embodiments, only one (or neither) horizontal component 21, 23 can extend beneath the vertical support members, but can instead laterally abut one or both of the vertical members.

The header member 16 can be formed from a variety of materials and in a variety of configurations, as will be dictated by the roof load of the structure being erected. In one aspect, however, the header member is formed from the same material as are the other horizontal, vertical and diagonal members, except that it is rotated such that the larger of its width or thickness is extending vertically. For example, if typical "2×4s" are used to construct the panel of FIG. 1, the two inch dimension is exposed in all of the vertical, horizontal and diagonal support members of FIG. 1, except that the header member (comprised of two panels 25, 27) is shown having a height of four inches (which is actually about 3½ inches, as will be appreciated by one of ordinary skill in the art). Thus, the header member panels are simply rotated and stacked two deep to provide the header).

The breakaway view shown at 102 illustrates that the header member 16 can be formed of two horizontal components 25, 27. This view also illustrates one manner in which the header member can be coupled to the vertical support member 12*b* (and also 12*a*, but that coupling is not shown in this view). In this aspect of the invention, the header member sits atop vertical support 17, yet abuts vertical support 19: that is, vertical support 19 extends flush with an upper surface of the header member. It is also possible that the header member sits atop both vertical supports, or that it abuts inside portions of the vertical support 12*b* (and thus does not sit atop any portion of support 12*b*). Typically, however, as each panel 10 constitutes a discrete panel, the header member will not extend laterally beyond outer edges of the vertical support members 12*a*, 12*b*.

As shown in FIG. 1, numerous horizontal purlin members 18, 18', etc., can extend between the vertical support members 12*a*, 12*b*. The number of horizontal members can vary, but will typically increase as the height of the wall increases. Typically, the horizontal purlins will be spaced no more than two feet from one another, on center. In some embodiments, this spacing is sixteen inches on center.

Figure 2:
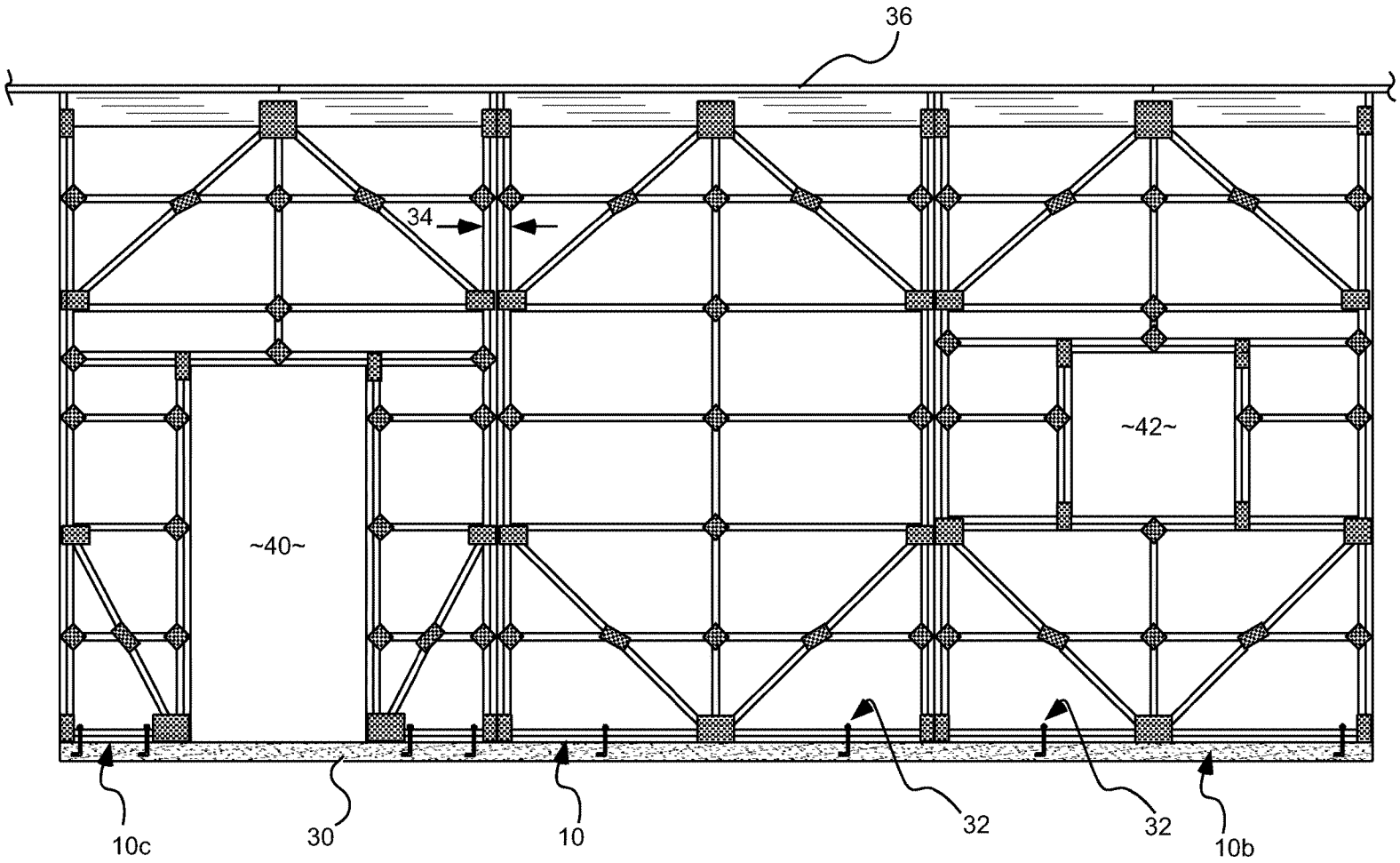
FIG. 2 is a plan view of a series of construction panels arranged into a wall member in accordance with an embodiment of the invention.

Turning now to FIG. 2, it can be seen how an entire wall can be constructed using the panels of the present invention. By extension, one of ordinary skill in the art, having possession of this disclosure, will readily appreciate how all of the walls of an entire building or structure can be formed using the present panels. In the example shown, three wall panels are utilized: panel 10, panel 10*b* and panel 10*c*. Each of the wall panels can be positioned atop a concrete foundation 30, and can be bolted thereto by lagbolts or anchor bolts and nuts (shown by example at 32). A "very top board" 36 can extend across one or more of the wall panels to distribute load evenly across each panel. The wall panels 10, 10*b*, 10*c*, etc., are coupled to one another at the vertical support members (12*a*, 12*b* in FIG. 1), thereby forming what is essentially a square post at this joints. While not so required, in one aspect the wall panels can be coupled to one another using bolts and nuts (at location 34, for example). This not only provides a very secure connection, but also allows the panels to be relatively easily dissembled at a later date, if so desired.

In addition to the configuration shown in FIG. 1, the wall or construction panels of the present invention can be assembled into a structure by attachment to piers, hanging between posts in the ground, etc. Due to the very high shear loading capability of the present panels, they are well suited for a wide variety of applications in which prior art systems lacked sufficient strength or rigidity to perform well.

The embodiment illustrated in FIG. 2 also shows how readily the present invention can allow the incorporation of door and window openings, 40 and 42, respectively, into the design of the wall panels.

In addition to the structural components discussed above, the present invention also provides a method of forming a wall of a building or structure. The method can include obtaining a plurality of panels as described above; arranging the panels such that each abuts a side of another; and fastening the panels one to another. The panels can be removably or permanently coupled one to another. At least some of the plurality of panels can include door or window openings formed therein.

The present invention also provides a method of forming a construction panel, including: arranging a pair of vertical support members substantially parallel to one another; coupling at least one lower horizontal member to the vertical support members; coupling at least one header member between upper ends of the pair of vertical support members; bracing the vertical support members with at least one horizontal purlin member positioned intermediate the lower horizontal member and the header member; coupling at least one intermediate vertical member between the at least one horizontal purlin member and one of: another horizontal purlin member; the header member; and the at least one lower horizontal member; coupling at least two diagonal support members between a horizontal member and one of the vertical support members; wherein each of a plurality of connection joints created between adjoining members are fastened by a fastening plate at each connection joint in the construction panel.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

I claim:

1. A construction panel for use in erecting structures, the construction panel having a front face and a rear face, the construction panel comprising:

a pair of wooden outer vertical support members, each of the wooden outer vertical support members having a front face and a rear face with a panel thickness defined therebetween;

at least one wooden lower horizontal member, extending between lower ends of the pair of wooden outer vertical support members, the at least one wooden lower horizontal member having a front face and a rear face;

at least one wooden header member, extending between upper ends of the pair of wooden outer vertical support members, the at least one wooden header member having a front face and a rear face;

at least one wooden horizontal purlin member, extending as a continuous, uninterrupted unit between, and abutting each of, the pair of wooden outer vertical support members so as to brace the pair of wooden outer vertical support members intermediate the at least one wooden lower horizontal member and the at least one wooden header member, the at least one wooden horizontal purlin member having a front face and a rear face;

at least one wooden intermediate vertical member, abutting a top or a bottom surface of the at least one wooden horizontal purlin member and abutting and extending between a top or a bottom surface of another wooden horizontal purlin member, a top or a bottom surface of the wooden header member, the at least one wooden intermediate vertical member having a front face and a rear face;

at least two wooden diagonal support members bracing the pair of wooden outer vertical support members, one of the at least two wooden diagonal support members extending from one of the pair of wooden outer vertical support members to a first wooden horizontal member, and one of the at least two wooden diagonal support members extending from the first wooden horizontal member to a second wooden horizontal member, the at least two wooden diagonal support members each having a front face and a rear face;

each of the front faces of the pair of wooden outer vertical support members, the at least one wooden lower horizontal member, the at least one wooden header member, the at least one wooden horizontal purlin member, and the at least one wooden intermediate vertical member being aligned in a plane common with a plane of the front face of the construction panel;

each of the pair of wooden outer vertical support members, the at least one wooden lower horizontal member, the at least one wooden horizontal purlin member, and the at least one wooden intermediate vertical member having a thickness common with the panel thickness;

each of the rear faces of the pair of wooden outer vertical support members, the at least one wooden lower horizontal member, the at least one wooden horizontal purlin member, and the at least one wooden intermediate vertical member being aligned in a plane common with a plane of the rear face of the construction panel; and a plurality of nail or truss plates, arranged about the construction panel to couple members one to another at each connection joint created between adjoining members.

2. The panel of claim 1, wherein the nail or truss plates are attached in pairs on opposing sides of the construction panel at each connection joint.

3. The panel of claim 1, wherein the at least two wooden diagonal support members abut a lower surface of the at least one wooden header member at a horizontal center of the at least one wooden header member.

4. The panel of claim 1, wherein the at least one wooden header member extends no further than an outside edge of each of the pair of wooden outer vertical support members.

5. The panel of claim 1, wherein each of the pair of wooden outer vertical support members includes at least two wooden vertical members abutting one another.

6. The panel of claim 5, wherein the at least one wooden header rests atop the at least one wooden intermediate vertical member and abuts the pair of wooden outer vertical support members.

7. The panel of claim 1, further comprising a plurality of wooden horizontal purlin members extending between the pair of wooden outer vertical support members, the plurality of wooden horizontal purlin members vertically spaced no more than two feet on center one from another.

8. A method of forming a construction panel having a front face and a rear face, the construction panel, comprising:

arranging a pair of wooden outer vertical support members substantially parallel to one another, the pair of wooden outer vertical support members having a front face and a rear face with a panel thickness defined therebetween;

coupling at least one wooden lower horizontal member to the pair of wooden outer vertical support members, the at least one wooden lower horizontal member having a front face and a rear face;

coupling at least one wooden header member between upper ends of the pair of wooden outer vertical support members, the at least one wooden header member having a front face and a rear face;

bracing the pair of wooden outer vertical support members with at least one wooden horizontal purlin member positioned intermediate the at least one wooden lower horizontal member and the at least one wooden header member, the at least one wooden horizontal purlin member extending as a continuous, uninterrupted unit between, and abutting each of, the pair of wooden outer vertical support members, the at least one wooden horizontal purlin member having a front face and a rear face;

coupling at least one wooden intermediate vertical member abutting a top or a bottom surface of the at least one wooden horizontal purlin member and abutting and extending between: a top or a bottom surface of another wooden horizontal purlin member, the at least one wooden intermediate vertical member having a front face and a rear face;

coupling at least two wooden diagonal support members between a wooden horizontal member and one of the wooden outer vertical support members, the at least two wooden diagonal support members having a front face and a rear face; wherein each of the front faces of the pair of wooden outer vertical support members, the at least one wooden lower horizontal member, the at least one wooden header member, the at least one wooden horizontal purlin member, the at least one wooden intermediate vertical member and the at least two wooden diagonal support members are aligned in a plane common with the front face of the construction panel;

each of the pair of wooden outer vertical support members, the at least one wooden lower horizontal member, the at least one wooden horizontal purlin member, and the at least one wooden intermediate vertical member having a thickness common with the panel thickness;

each of the rear faces of the pair of wooden outer vertical support members, the at least one wooden lower horizontal member, the at least one wooden horizontal purlin member, the at least one wooden intermediate vertical member and the at least two wooden diagonal support members are aligned in a plane common with the rear face of the construction panel; and wherein each adjoining member is fastened by a nail or truss plate at each connection joint in the construction panel.

9. The method of claim 8, wherein the nail or truss plates are attached in pairs on opposing sides of the construction panel at each connection joint.

10. The method of claim 8, wherein the pair of wooden diagonal support members are coupled to the at least one wooden header member at a horizontal center of the at least one wooden header member.

11. The method of claim 8, wherein the at least one wooden header member extends no further than an outside edge of each of the pair of wooden outer vertical support members.

12. The method of claim 8, further comprising two pairs of wooden diagonal support members, one pair of wooden diagonal support members extending from the at least one wooden lower horizontal member to the pair of wooden outer vertical support members, and one pair of wooden diagonal support members extending from a wooden horizontal purlin to the at least one wooden header member.

13. The panel of claim 1, wherein all wooden lower horizontal members, wooden header members, wooden horizontal purlin members, wooden intermediate vertical members and wooden diagonal support members are formed from a material selected from the group consisting of: dimensional wood lumber; LVL wood products; or engineered wood products.

14. The panel of claim 1, wherein the at least one wooden horizontal purlin member is formed of a single piece of material.

15. A method of forming a wall of a building, comprising:

obtaining a plurality of construction panels, each construction panel having a front face and a rear face and comprising:

a pair of wooden outer vertical support members, the pair of wooden outer vertical support members each having a front face and a rear face with a panel thickness defined therebetween;

at least one wooden lower horizontal member, extending between lower ends of the pair of wooden outer vertical support members, the at least one wooden lower horizontal member having a front face and a rear face;

at least one wooden header member, extending between upper ends of the pair of wooden outer vertical support members, the at least one wooden header member having a front face and a rear face;

at least one wooden horizontal purlin member, extending as a continuous, uninterrupted unit between, and abutting each of, the pair of wooden outer vertical support members and bracing the pair of wooden outer vertical support members intermediate the at least one wooden lower horizontal member and the at least one wooden header member, the at least one wooden horizontal purlin member having a front face and a rear face;

at least one wooden intermediate vertical member, abutting a top or a bottom surface of the at least one wooden horizontal purlin member and abutting and extending between a top or a bottom surface of another wooden horizontal purlin member, the at least one wooden intermediate vertical member having a front face and a rear face;

at least two wooden diagonal support members bracing the pair of wooden outer vertical support members, each of the at least two wooden diagonal support members extending from one of the pair of wooden outer vertical support members to a wooden horizontal member, the at least two wooden diagonal support members each having a front face and a rear face; and a plurality of nail or truss plates, arranged about the construction panel to couple members one to another at each connection joint created between adjoining members;

each of the front faces of the pair of wooden outer vertical support members, the at least one wooden lower horizontal member, the at least one wooden header member, the at least one wooden horizontal purlin member, the at least one wooden intermediate vertical member and the at least two wooden diagonal support members are aligned in a plane common to a front face of the construction panel;

each of the pair of wooden outer vertical support members, the at least one wooden lower horizontal member, the at least one wooden horizontal purlin member, and the at least one wooden intermediate vertical member having a thickness common with the panel thickness;

each of the rear faces of the pair of wooden outer vertical support members, the at least one wooden lower horizontal member, the at least one wooden horizontal purlin member, the at least one wooden intermediate vertical member and the at least two wooden diagonal support members are aligned in a plane common to the rear face of the construction panel;

arranging the plurality of construction panels such that wooden outer vertical support members of a first construction panel abut outer wooden vertical support members of an adjoining construction panel to thereby form a vertical post; and fastening the plurality of construction panels one to another.

16. The method of claim 15, wherein fastening plurality of the construction panels comprises removably coupling the plurality of construction panels one to another.

17. The method of claim 15, wherein at least some of the plurality of construction panels include door or window openings formed therein.

* * * * *